US007623075B2

(12) United States Patent
Apostolos

(10) Patent No.: US 7,623,075 B2
(45) Date of Patent: Nov. 24, 2009

(54) ULTRA COMPACT UHF SATCOM ANTENNA

(75) Inventor: John T. Apostolos, Lyndborough, NH (US)

(73) Assignee: BAE Systems Information and Electronics Systems Integration Inc., Nashua, NH (US)

( * ) Notice: Subject to any disclaimer, the term of this patent is extended or adjusted under 35 U.S.C. 154(b) by 0 days.

(21) Appl. No.: 12/152,295

(22) Filed: May 14, 2008

(65) Prior Publication Data

US 2009/0073049 A1 Mar. 19, 2009

Related U.S. Application Data

(60) Provisional application No. 60/937,116, filed on Jun. 25, 2007.

(51) Int. Cl.
*H01Q 1/38* (2006.01)
*H01Q 21/26* (2006.01)

(52) U.S. Cl. ..... 343/700 MS; 343/797

(58) Field of Classification Search ..... 343/797, 343/700 MS, 795, 833, 741
See application file for complete search history.

(56) References Cited

U.S. PATENT DOCUMENTS 6,373,446 B2 * 4/2002 Apostolos ..... 343/797
6,690,331 B2 * 2/2004 Apotolos ..... 343/744
6,888,510 B2 * 5/2005 Jo et al. ..... 343/797
7,436,369 B2 * 10/2008 Apostolos ..... 343/741

* cited by examiner

*Primary Examiner*—Michael C Wimer
*Assistant Examiner*—Kyana R Robinson
(74) *Attorney, Agent, or Firm*—Robert K. Tendler; Daniel J. Long

(57) ABSTRACT

A miniature volumetric spherical geometry with multiple symmetric feeds is spaced from the surface of the vehicle or platform, with the antenna exhibiting both circular polarization that is orientation-independent or angle of arrival independent, while at the same time covering a broad band of frequencies from 243-318 MHz in one embodiment.

16 Claims, 7 Drawing Sheets

ULTRA COMPACT UHF SATCOM ANTENNA

CROSS REFERENCE TO RELATED APPLICATION

This Application claims rights under 35 USC § 119(e) from U.S. Application Ser. No. 60/937,116 filed Jun. 25, 2007, the contents of which are incorporated herein by reference.

FIELD OF THE INVENTION

This invention relates to omni directional antennas and more particularly to an ultra compact circularly polarized UHF satcom antenna.

BACKGROUND OF THE INVENTION

As described in a copending application filed on an even date herewith by John T. Apostolos entitled Orientation-Independent Antenna (ORIAN), assigned to the assignee hereof and incorporated herein by reference, a pair of crossed vertical loops in combination with a horizontal loop may be phased to provide circular polarization in a hemisphere surrounding the antenna such that signals are robustly received regardless of their polarization or angle of arrival. The antenna described in this copending Application is a free standing antenna used, inter alia, on robots or robotic vehicles so that regardless of the angle of arrival of the incoming signal or its polarization the signals will be robustly received. This means that relatively low power signals as from satellites can be received by this orientation-independent antenna.

In one embodiment of the antenna, this antenna is in the form of a cube with various triangular shaped antenna elements disposed on the surface of the cube. Through a relatively sophisticated phasing network, the vertical crossed loops associated with the antenna are fed 90 degrees out of phase, as is a horizontal loop which is 90 degrees out of phase with both of the crossed vertical loops.

Stepped phasing is also utilized for the various legs of the loops of the antenna. Note that the net result is that the crossed vertical loops provide circular polarization at the azimuth but require a horizontal polarization component fill close to the zenith or horizon.

While the orientation-independent antenna described above is useful in many applications, there is a requirement for a UHF antenna that is miniaturized and broad banded to be mounted on the top of a car, vehicle or any other platform such a turret. The broad banded nature of such an antenna is to eliminate the need for a number of specialized antennas on the vehicle. Also what is required is a low profile antenna that is both efficient and has an orientation-independent characteristic.

The orientation-independent characteristic permits signals arriving at any angle of arrival above the horizon and any polarization to be received. As will be appreciated, polarization can vary from linear polarization to circular polarization or anywhere in between including elliptical polarization.

If one could somehow adapt the cubic orientation-independent antenna as a low profile antenna for use on vehicles, robust communications could be achieved over a wide bandwidth so as eliminate the forest of antennas that normally graces the vehicles or platforms.

Of course, not having a whip antenna would eliminate the snagging of the antenna in branches, trees and other obstacles and, for instance in the case of an aircraft in and about a naval vessel, the aircraft could be free of the vertical forest of antennas that usually is present on warships.

SUMMARY OF THE INVENTION

It has been found that an orientation-independent circular polarized antenna can be provided utilizing the cubic structure mentioned above without the horizontal loop or sophisticated phasing. The antenna may be driven from beneath using only four triangular elements at the underside or base of the cubic antenna.

Gone also are the quadrature type triangular elements at the sides of the cube, with the only triangular shaped elements being those at the bottom of the cube and a mirror image of the bottom elements at the top of the cube.

By appropriately phasing the elements at the bottom of the cube, one achieves the aforementioned crossed vertical loop circular polarization characteristic at the azimuth of the antenna.

While in the orientation-independent antenna mentioned above, the horizontal component is filled in by a horizontally positioned loop in the subject invention no such loop is required.

Rather, with the antenna physically isolated from a platform, it has been discovered that the conductive roof of a car or vehicle, the top plate of a turret, or indeed any conductive platform provides the same type of horizontal component fill in. This assumes that the cube is spaced from the platform and means that the antenna will have a circular polarized characteristic close to the zenith or horizon.

Thus, the subject antenna exhibits a near hemispherical circular polarization characteristic down almost to the horizon when the antenna is spaced from the platform. As will be appreciated, without having to provide an additional horizontal loop, the subject antenna can be fed at four points at the bottom of the antenna to provide the circular polarization characteristic, with the feed being provided by a cable coming up through the bottom to simplify construction.

In order to fine tune the antenna, a top plate that overlies a portion of the top triangular shaped antenna elements is spaced from the top antenna elements and is adjusted to provide for the fine tuning of the antenna.

In summary, a miniature volumetric spherical geometry with multiple symmetric feeds is spaced from the surface of the vehicle or platform, with the antenna exhibiting both circular polarization that is orientation-independent or angle of arrival independent, while at the same time covering a broad band of frequencies from 243-318 MHz in one embodiment.

BRIEF DESCRIPTION OF THE DRAWINGS

These and other features of the subject invention will be better understood in connection with a detailed description of which.

DETAILED DESCRIPTION

Figure 1:
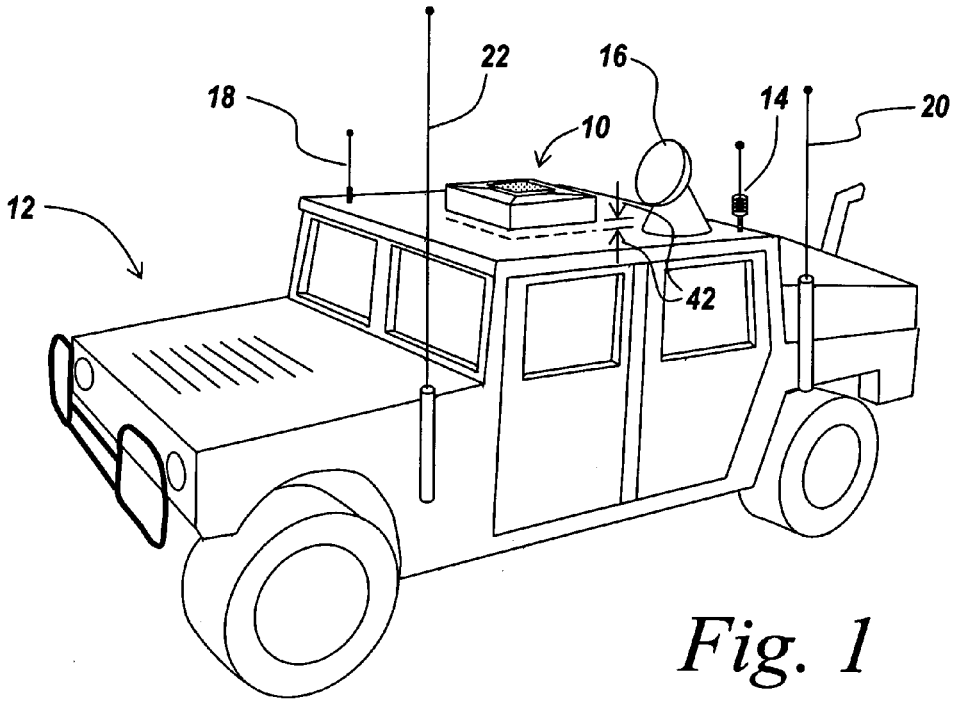
FIG. 1 is a diagrammatic illustration of a vehicle with a number of antennas extending upwardly from the roof thereof, showing the utilization of the subject ultra compact UHF satcom antenna spaced through the top of the vehicle.

Referring now to FIG. 1, a compact UHF satcom antenna 10 is a volumetric based antenna with emphasis on hemispheric coverage, small size, and minimal interaction with the platform in one embodiment being for use on ground vehicles.

The vehicle itself is shown at 12 and normally has a forest of antennas extending therefrom, such as antennas 14, 16, 18, 20 and 22.

Note these antenna have the obvious disadvantage of antennas which protrude up from the vehicle that can be snagged or caught or run into. For instance when these antennas are mounted on naval vessels, it is important that aircraft steer clear.

While satellite antennas may be vertically polarized, as indicated by the various whip type antennas, it will be appreciated that they are sensitive to the angle of arrival and polarization of the incoming signals. Moreover, because each of the antennas is specifically designed for a given frequency range and application, the vehicle itself must be provided with the variety of such antennas.

This is somewhat problematical, both because of the real estate available on the vehicle or robot, to say nothing of the extended nature of these antennas which can hit obstacles.

What will be appreciated is that antenna 10 is a low profile antenna which has minimal interaction with the platform.

Figure 2:
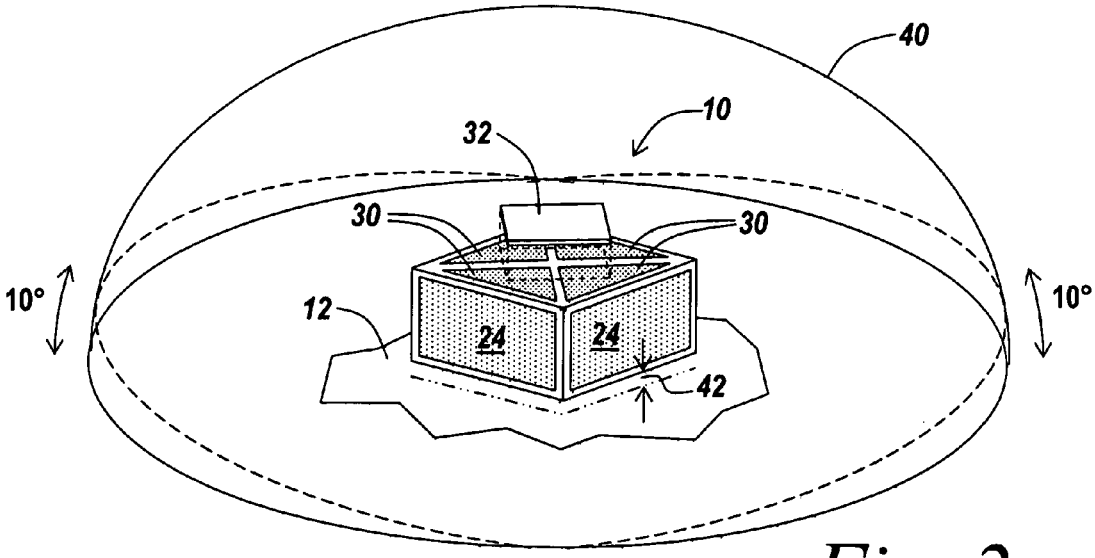
FIG. 2 is a diagrammatic illustration of the close to hemispherical coverage of the antenna of FIG. 1 in which the antenna exhibits circular polarization at all angles or arrival within the hemisphere, thus to be able to robustly detect incoming signals regardless of polarization direction.

Referring to FIG. 2, antenna 10 has solid sheets 24 on the sides of the cube which are connected by matching and balancing impedances. The top surface of the cube is provided with pairs of triangular shaped elements 30 which are passive in nature and which form isolated quadrants. As will be discussed, these elements are mirrored on the bottom portion of the cube and are driven in a specific phased relationship to be able to provide vertical crossed loops that in turn provide circular polarization at the azimuth of the antenna.

Also shown in this figure is a tuning plate 32 which is spaced above elements 30 to provide for fine tuning.

It is the purpose of this antenna to provide a hemispherical circular polarization characteristic such as shown at 40, which extends down almost to the horizon without the utilization of the aforementioned horizontally oriented loop.

It has been found by spacing the antenna 10 from vehicle platform 12 in one embodiment 1.5 inches above the platform, as illustrated by arrow 42, that an almost hemispherical coverage can be achieved in which circular polarization is maintained down to about 10 degrees above the horizon.

Figure 3:
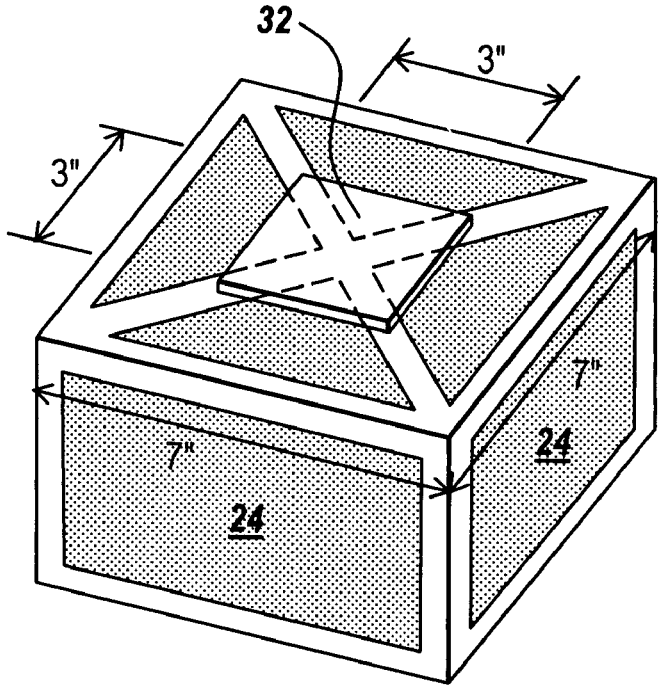
FIG. 3 is diagrammatic illustration of the top view of the antenna of FIG. 1 showing passive triangular shaped antenna elements overlaid with a tuning plate.

Prior to describing the drive of the antenna referring to FIG. 3, it can be seen that in one embodiment the sides of the cube 24 are seven inches on a side, whereas the tuning plate 32 is three inches on a side.

Figure 4:
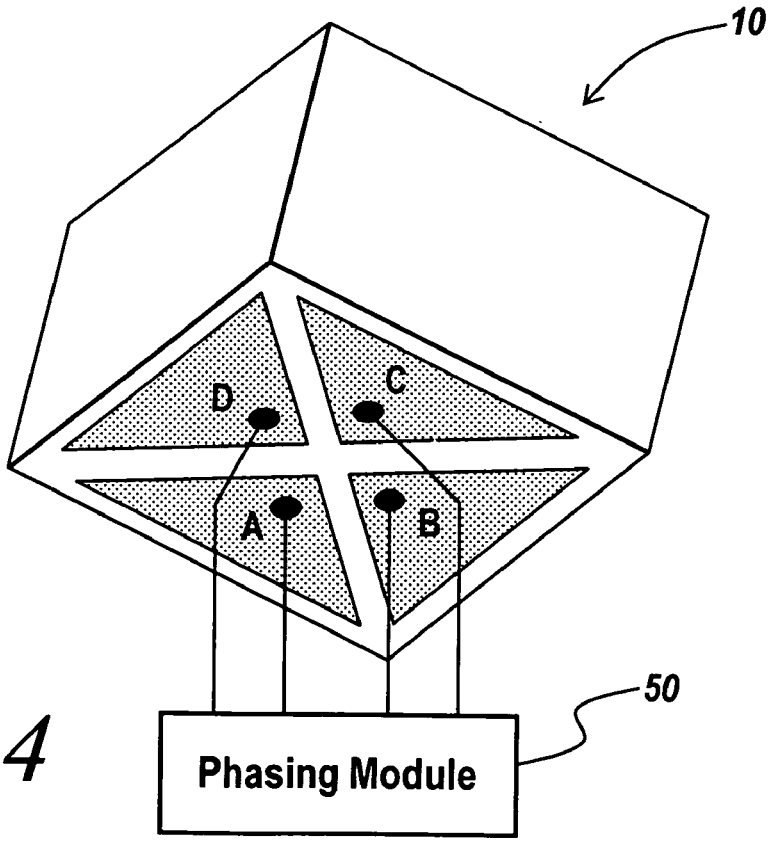
FIG. 4 is a diagrammatic illustration of the bottom of the cube of FIG. 3 illustrating a mirror image of the passive top plates in which opposed triangular elements are driven with a phasing module to provide the vertical crossed loops that provide circular polarization about the azimuth.

Referring now to FIG. 4, the triangular opposed elements A, B, C and D are shown with the vertices of elements A, B, C and D forming the feed region of the antenna. Here it can be seen that a phasing module 50 is utilized to feed the antenna. The purpose of the phasing module to excite a feed region, at least in the satcom mode, by progressive phases 0, 90, 180 and 270 degrees. This phasing is for right hand circular polarization with the left hand circular polarization being (0 degrees), (−90 degrees), (180 degrees) and (90 degrees).

Figure 5:
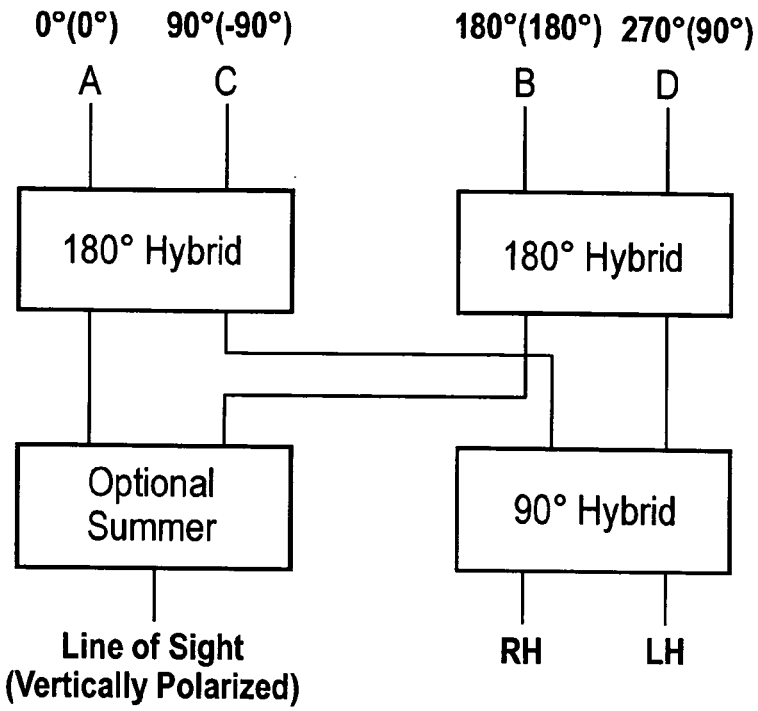
FIG. 5 is a diagrammatic illustration of the phasing provided by the phasing module of FIG. 4, in which the antenna may be given either right hand circular polarization or left hand circular polarization and in which an optional summer is utilized to provide the equivalent a whip antenna that is vertically polarized, whereby in addition to the satcom application, line of sight communications is also providable by the subject antenna.

The drive provided by phasing module 50 is shown in FIG. 5 to include two 180 degree hybrids and a 90 degree hybrid. Here, hybrid 52 drives elements A and C respectively at 0 degrees and 90 degrees, whereas hybrid 54 drives elements B and D respectively at 180 degrees and 270 degrees.

A 90 degree hybrid 56 is utilized to drive hybrid 52 and hybrid 54 by taking the output of the 90 degree hybrid 56 and applying it to the negative input terminal of either hybrid 52 or hybrid 54. In this manner, the antenna may be energized to provide either right hand circular polarization or left hand circular polarization, although right hand circular polarization is the usual polarization characteristic for satellite communications.

An optional summer 58 is coupled to the unused ports of the 180 degree hybrids so that a line-of-sight antenna vertically polarized can be simultaneously provided by antenna 10.

Figure 6:
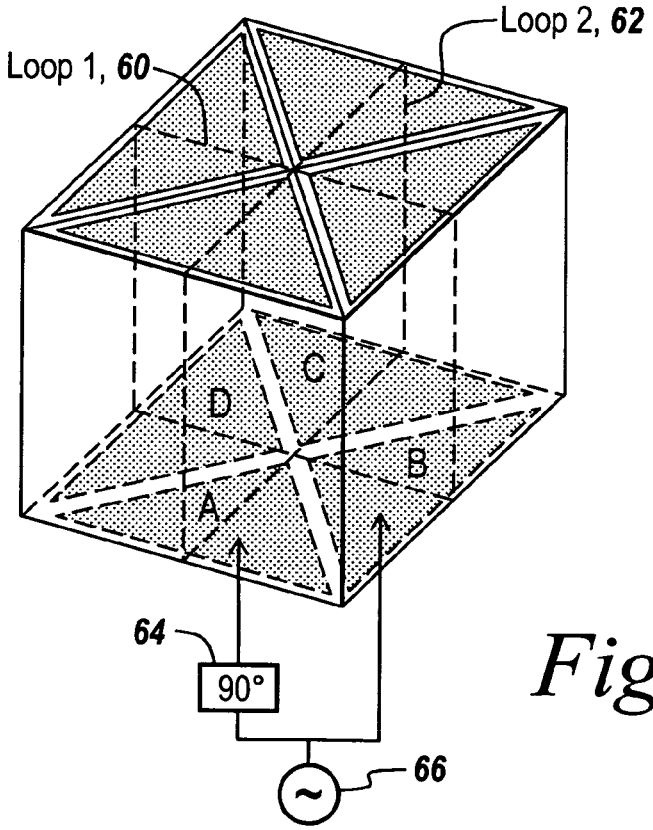
FIG. 6 is a diagrammatic illustration of the formation of vertical crossed loops through the feeding of the two loops 90 degrees out of phase.

Referring to FIG. 6, the drive of the antenna's elements A, B, C and D is such as to provide crossed loops, namely Loop 1 and Loop 2 here illustrated by dotted lines 60 and 62. It will be seen that due to the phasing associated with the phasing module 50 in FIG. 4 or the hybrids of FIG. 5 that the two loops are driven 90 degrees out of phase, as shown at 64 to provide for the circular polarization at the azimuth of the antenna when coupled to a signal source 66.

Figure 7:
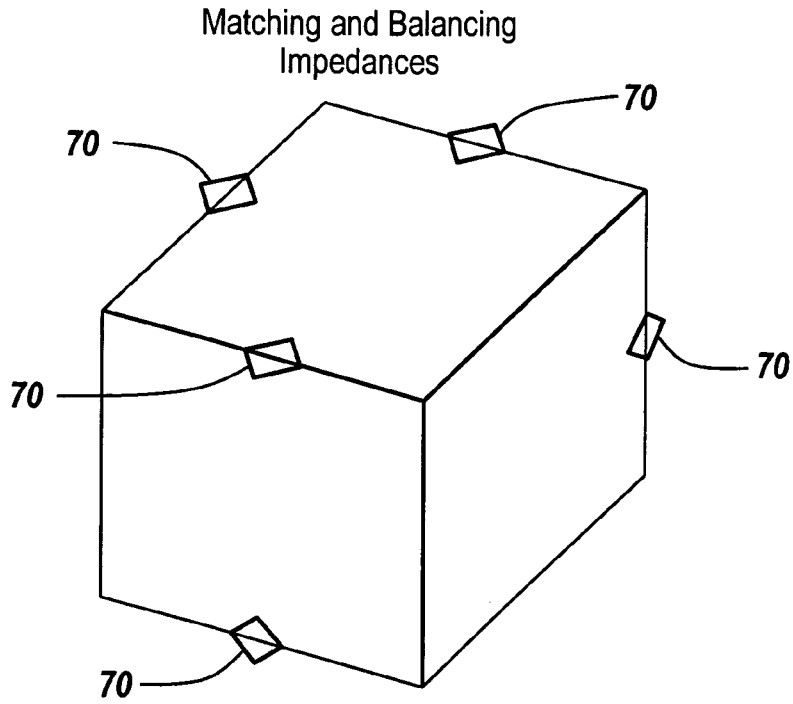
FIG. 7 is a diagrammatic illustration of the utilization matching and balancing impedances for the antenna of FIGS. 3, 4 and 5.

Note that two coax fees can be utilized with ferrite sleeves to prevent currents on the outer conductor, however, one 90 degree hybrid is utilized. The matching and balancing impedances shown in FIG. 7 at 70 are parallel combinations of capacitors and meanderlines in one embodiment. The proper choice of impedances results in the match across the satcom band and relative immunity of the input impedances from platform proximity.

As mentioned above, in one embodiment the height of a 7"×7"×7" antenna above a platform was 1.5, inches with the platform in one embodiment being a 10 foot by 10 foot ground plane.

RANGE TESTS

Tests were made to determine what could be achieved in terms of minimum volume and weight, while at the same time maintaining the required gain determined by typical system link analysis. Measurements were taken at 243 mhz and 318 mhz on the antenna range. The antenna was mounted in the center of a 10 foot by 10 foot ground plane which was mast mounted at a height of 15 feet. Elevation cuts were taken from 30 degrees below the horizon to 90 degrees above the horizon. Results indicate that the 7-inch cube which comprises the UHF satcom antenna is large enough to meet typical link analysis derived gain specifications.

Figure 8:
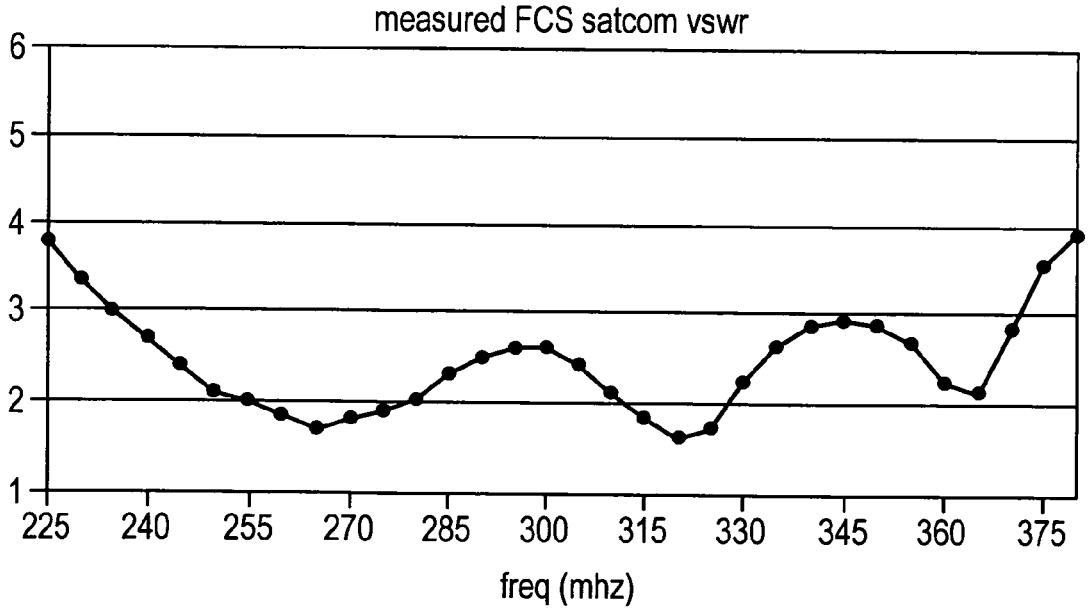
FIG. 8 is a graph showing VSWR across the satcom band 243-318 mhz for a preferred embodiment of the present invention; and, FIGS. 9-14 are graphs of gain versus elevation in various tests in a preferred embodiment described herein.

Measurements of the incident field (with no ground plane) were made indicating that satisfactory phase and amplitude uniformity were present. Horizontal polarization was used at the transmitter and the ground plane was rotated in the polarization plane of incidence. The resulting rotation gives rise to an equivalent vertical polarization response elevation cut of the satcom antenna along one of the sides or, as seen in FIG. 8, at 0 degrees azimuth. The equivalent horizontal polarization response was derived by means of the FEKO antenna model. The gain standard was a half wave horizontal dipole.

V-POL RESULTS

Figure 9:
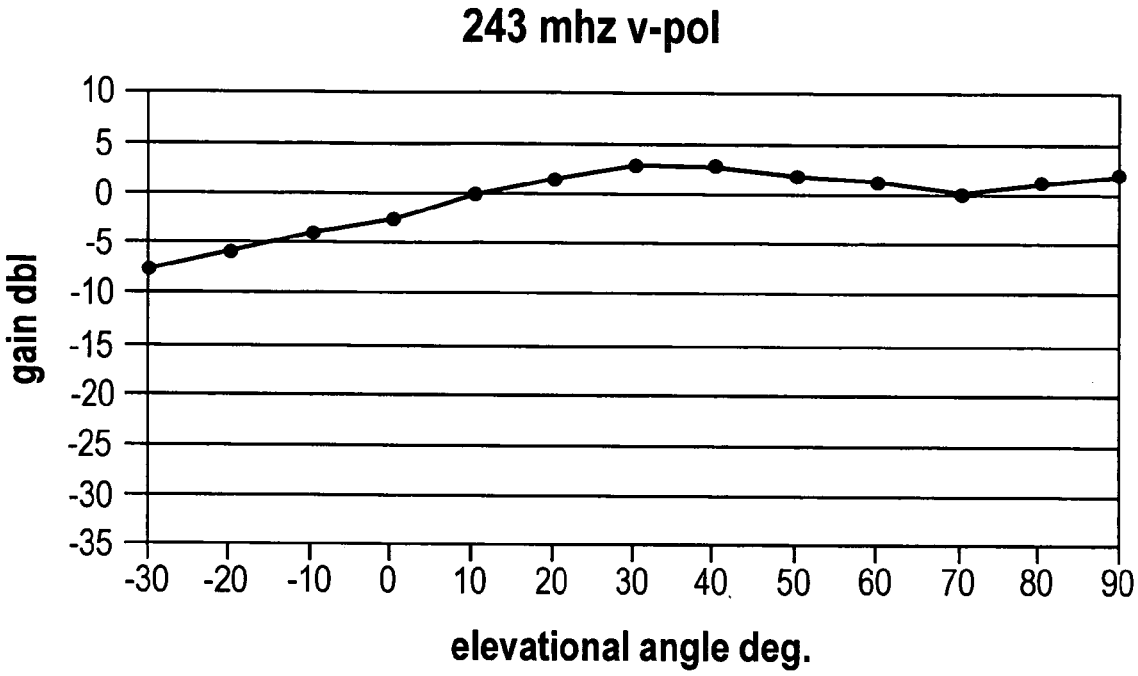
Figure 10:
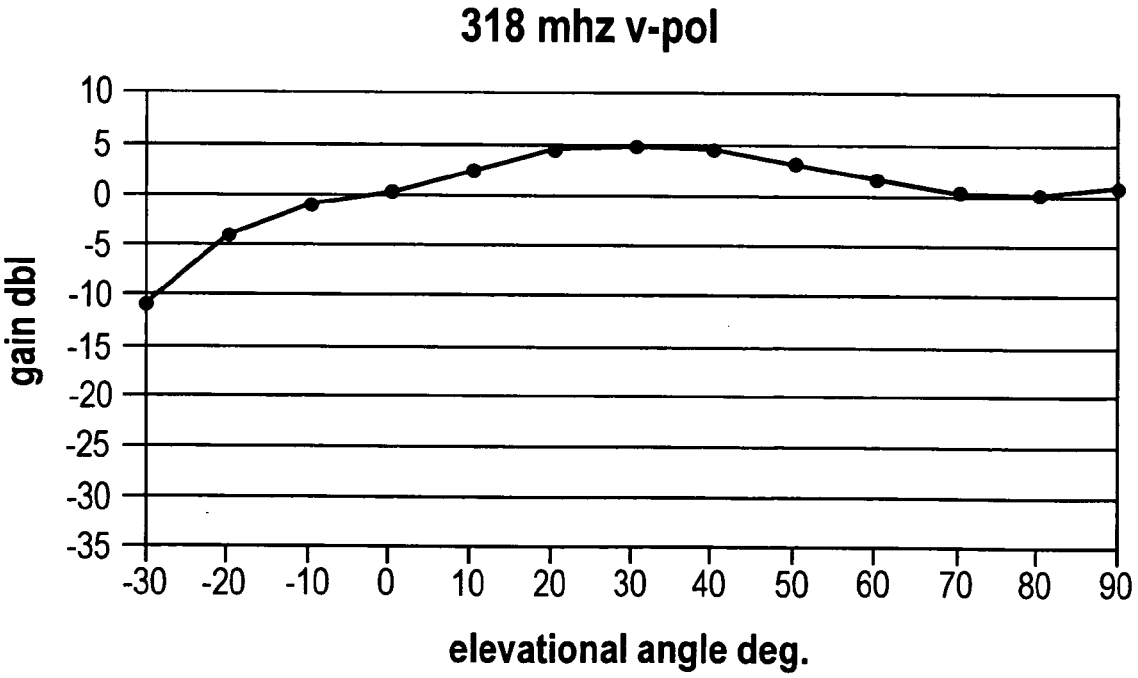

The results of vertical polarization elevation cuts at 243 mhz and 318 mhz at 0 degrees azimuth are shown in FIGS. 9 and 10.

H-POL RESULTS

Figure 11:
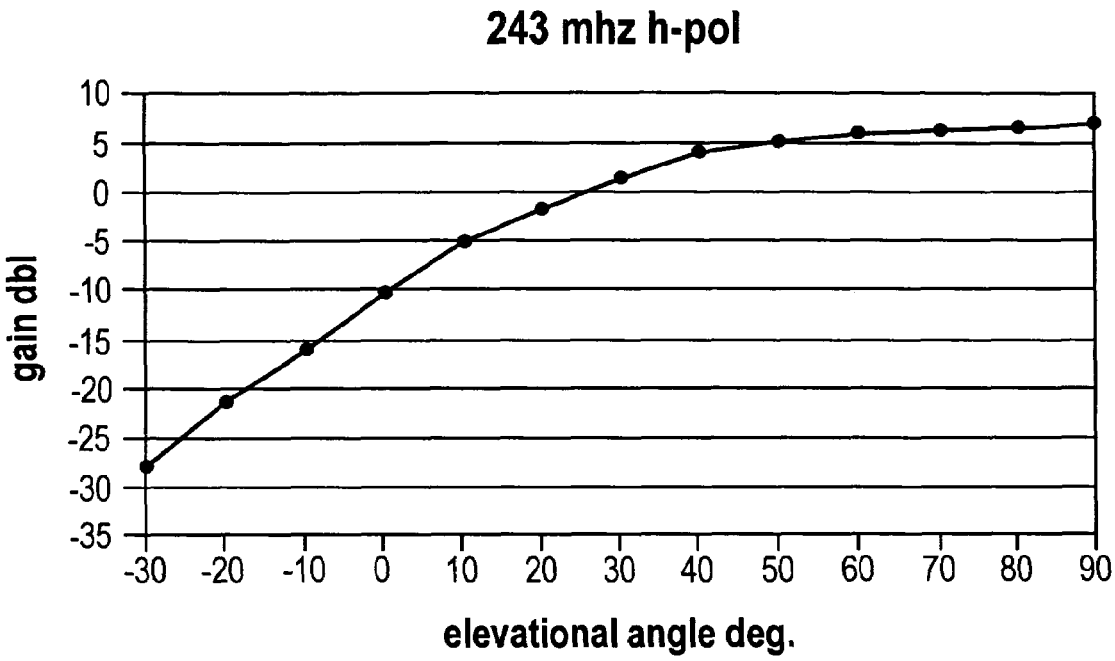
Figure 12:
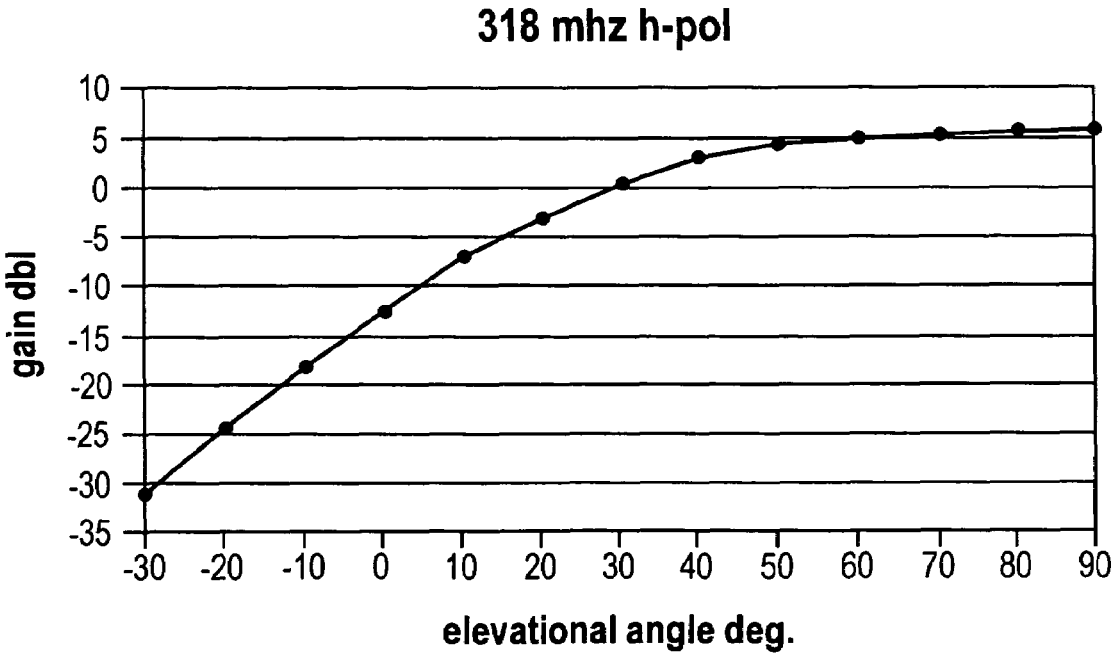

The results of horizontal polarization cuts mhz and 318 mhz at 0 degrees azimuth are shown below in FIGS. 11 and 12.

C-POL RESULTS

Figure 13:
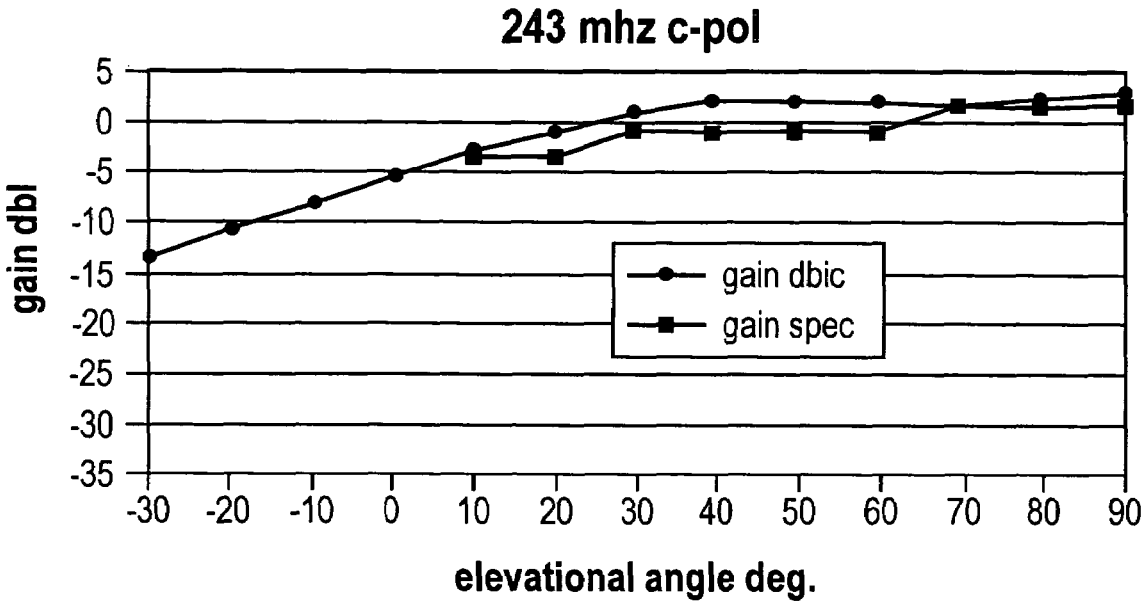
Figure 14:
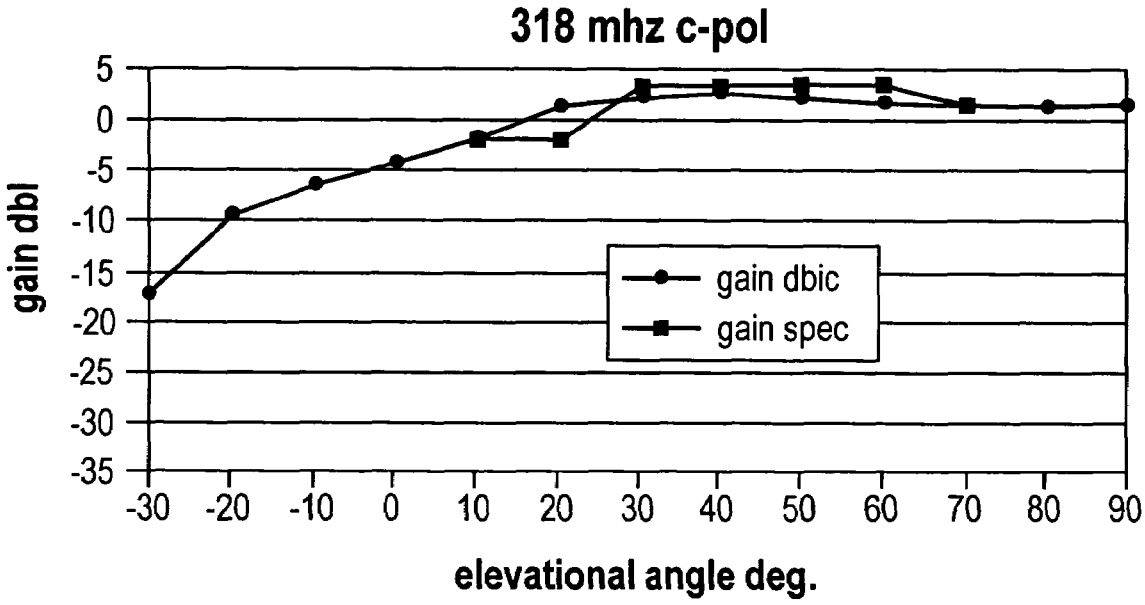

The results of combining the horizontal polarization and vertical polarization cuts to arrive at the c-pol gains at 243 mhz and 318 mhz are shown below in FIGS. 13 and 14.

CONCLUSION

The 7-inch cube UHF satcom antenna is extremely close to meeting typical link analysis derived gain specs, especially if the specs above are to be met 90 percent of the time.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An ultra compact UHF satcom antenna mountable on a platform that forms a ground plane, comprising:

a cubic substrate having antenna elements thereon, said cubic substrate having sides carrying rectilinear elements and a top and bottom having triangular elements with opposed triangular elements having opposed apexes, the elements on the top of said cube being a mirror image of those on the bottom of said cubic substrate; and, a phasing network coupled to selected elements on the bottom of said cubic substrate for providing a circular polarization characteristic for said antenna at least in a hemisphere with said antenna at its center.

2. The antenna of claim 1, wherein the vertices of selected elements on the bottom of said cube are successively phased at 0 degrees, 90 degrees, 180 degrees and 270 degrees.

3. The antenna of claim 1, wherein said triangular elements are phased so as to provide crossed vertical loops fed 90 degrees out of phase with each other.

4. The antenna of claim 1, wherein said phasing network includes a pair of hybrid networks, each having an input and two outputs, and a 90 degree hybrid network having one output coupled to an input of one of said 180 degree hybrids and another output coupled to an input of the other said 180 degree hybrids.

5. The antenna of claim 4, wherein said 90 degree hybrid has two inputs, one of said inputs being responsible for a right hand circular polarization characteristic of said antenna and the other said inputs being responsible for left hand circular polarization characteristic of said antenna.

6. The antenna of claim 4, wherein the outputs of said 180 degree hybrids are respectively 0 degrees, 90 degrees, 180 degrees and 270 degrees, thereby to provide a right hand circular polarization characteristic for said antenna.

7. The antenna of claim 4, wherein the outputs of said hybrids are respectively 0 degrees, minus 90 degrees, 80 degrees and 90 degrees, thereby to provide a left hand circular polarization characteristic for said antenna.

8. The antenna of claim 4, and further including a summer having one output coupled to the other of the inputs to the first of said 180 degree hybrids and having a second output coupled to the other input to the second of said 180 degree hybrids, whereby said antenna serves both as a circular polarization satcom antenna and a vertically polarized line-of-sight antenna.

9. The antenna of claim 1, wherein said cubic substrate is spaced from said platform.

10. The antenna of claim 9, wherein said spacing is such that said ground plane operates to fill in a horizontal component so that said antenna operates in an orientation-independent fashion presenting a circular polarization characteristic regardless of the angles of arrival of an incoming signal.

11. The antenna of claim 10, wherein said spacing is 1.5 inches above said platform.

12. The antenna of claim 1, and further including a tuning plate adjustable above the top surface of the elements on the top surface by said cubic substrate for fine tuning of said antenna.

13. The antenna of claim 1, and further including matching and balancing impedances at the edges of said cube.

14. The antenna of claim 13, wherein said matching and balancing impedances include a capacitor and a meanderline.

15. A method for providing a compact orientation-independent antenna, comprising:

providing a cubic antenna substrate;

locating quadrature antenna elements on the bottom of the cubic substrate;

providing matching quadrature antenna elements on the top of the cubic substrate;

locating the cubic substrate with the elements thereon above a ground plane; and, driving the elements on the bottom of the cubic substrate to produce a pair of vertical crossed loops that provide circular polarization at the azimuth of the antenna, the ground plane providing horizontal components to fill in so that the antenna has a circular polarization characteristic at or near the horizontal.

16. The method of claim 15, wherein the quadrature elements at the bottom of the cubic substrate are progressively phased at 0 degrees, 90 degrees, 180 degrees and 270 degrees.

* * * * *